US011346214B2

(12) United States Patent
Scott et al.

(10) Patent No.: US 11,346,214 B2
(45) Date of Patent: May 31, 2022

(54) MONITORING OF DOWNHOLE COMPONENTS DURING DEPLOYMENT

(71) Applicants: Thomas McClain Scott, Cypress, TX (US); Jason Harper, Cypress, TX (US); Pavel Nazarenko, Houston, TX (US)

(72) Inventors: Thomas McClain Scott, Cypress, TX (US); Jason Harper, Cypress, TX (US); Pavel Nazarenko, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 60 days.

(21) Appl. No.: 16/890,619

(22) Filed: Jun. 2, 2020

(65) Prior Publication Data

US 2021/0079787 A1 Mar. 18, 2021

Related U.S. Application Data

(60) Provisional application No. 62/900,338, filed on Sep. 13, 2019.

(51) Int. Cl.

| | |
|---|---|
| ***E21B 47/00*** | (2012.01) |
| ***E21B 47/13*** | (2012.01) |
| ***E21B 47/14*** | (2006.01) |

(52) U.S. Cl.

CPC ..... *E21B 47/14* (2013.01); *E21B 47/00* (2013.01); *E21B 47/13* (2020.05)

(58) Field of Classification Search

CPC ..... E21B 47/00; E21B 47/13; E21B 47/14

See application file for complete search history.

(56) References Cited

U.S. PATENT DOCUMENTS

| | | | | |
|---|---|---|---|---|
| 2003/0103211 | A1 | 6/2003 | Lange et al. | |
| 2010/0051269 | A1 | 3/2010 | Smithson et al. | |
| 2010/0133004 | A1 | 6/2010 | Burleson et al. | |
| 2012/0176250 | A1 | 7/2012 | Duncan et al. | |
| 2012/0273269 | A1 | 11/2012 | Rinzler et al. | |
| 2016/0230477 | A1* | 8/2016 | Tilley | E21B 17/023 |
| 2017/0211378 | A1* | 7/2017 | Derkacz | E21B 47/13 |
| 2018/0058202 | A1* | 3/2018 | Disko | E21B 47/017 |
| 2018/0135409 | A1* | 5/2018 | Wilson | H04B 1/38 |
| 2018/0179880 | A1* | 6/2018 | Sankaran | E21B 47/00 |

(Continued)

OTHER PUBLICATIONS

Notification of Transmittal of the International Search Report and the Written Opinion of the International Searching Authority, or the Declaration; International filing date Aug. 27, 2020; dated Dec. 4, 2020; 10 pages.

*Primary Examiner* — Daniel P Stephenson

(74) *Attorney, Agent, or Firm* — Cantor Colburn LLP

(57) ABSTRACT

A system for monitoring a downhole component includes a downhole sensing device configured to monitor a downhole component and generate component information during deployment of the of the downhole component to a selected location in a borehole in a resource bearing formation. The system also includes a downhole communication device connected to the downhole sensing device, the downhole communication device configured to wirelessly transmit a signal indicative of the component information to a surface location during the deployment.

16 Claims, 6 Drawing Sheets

(56) References Cited

U.S. PATENT DOCUMENTS

| | | | | |
|---|---|---|---|---|
| 2019/0128114 | A1* | 5/2019 | Bryant | E21B 47/06 |
| 2019/0203574 | A1* | 7/2019 | Yi | E21B 43/26 |
| 2019/0353030 | A1* | 11/2019 | Jarvis | E21B 47/06 |
| 2020/0011169 | A1* | 1/2020 | Haghshenas | E21B 47/00 |
| 2020/0190970 | A1* | 6/2020 | Alvarez | E21B 47/13 |
| 2020/0232319 | A1* | 7/2020 | Tubel | E21B 47/18 |
| 2020/0386096 | A1* | 12/2020 | Sugiura | E21B 47/26 |
| 2021/0079787 | A1* | 3/2021 | Scott | E21B 47/00 |
| 2021/0123342 | A1* | 4/2021 | Hudson | E21B 41/0085 |
| 2021/0215023 | A1* | 7/2021 | Hrametz | E21B 47/06 |

* cited by examiner

MONITORING OF DOWNHOLE COMPONENTS DURING DEPLOYMENT

CROSS REFERENCE TO RELATED APPLICATIONS

This application claims the benefit of an earlier filing date from U.S. Provisional Application Ser. No. 62/900,338 filed Sep. 13, 2019, the entire disclosure of which is incorporated herein by reference.

BACKGROUND

There are a variety of tools and components that are deployed downhole to facilitate production of hydrocarbons. Such components can include safety valves, inflow control valves, production screens and inflow control devices. In some cases, tools and components are deployed downhole using a running tool. For example, in two-trip systems, a first run component such as a lower completion string is run into a borehole, followed by a second run component such as an upper completion.

Tools, components, etc. that are run into a borehole system, whether in an open hole or a cased hole, are often instrumented. During the running of such tools, components, etc., communication with the components is not always available. Accordingly, it would be desirable to have means for communication with downhole tools during deployment.

SUMMARY

An embodiment of a system for monitoring a downhole component includes a downhole sensing device configured to monitor a downhole component and generate component information during deployment of the of the downhole component to a selected location in a borehole in a resource bearing formation. The system also includes a downhole communication device connected to the downhole sensing device, the downhole communication device configured to wirelessly transmit a signal indicative of the component information to a surface location during the deployment.

An embodiment of a method of monitoring a downhole component includes deploying a downhole component in a borehole in a resource bearing formation and advancing the downhole component to a selected location in the borehole, monitoring the downhole component during deployment by a downhole sensing device and generating component information, and wirelessly transmitting a signal during the deployment to a surface location by a downhole communication device connected to the downhole sensing device, the signal indicative of the component information.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
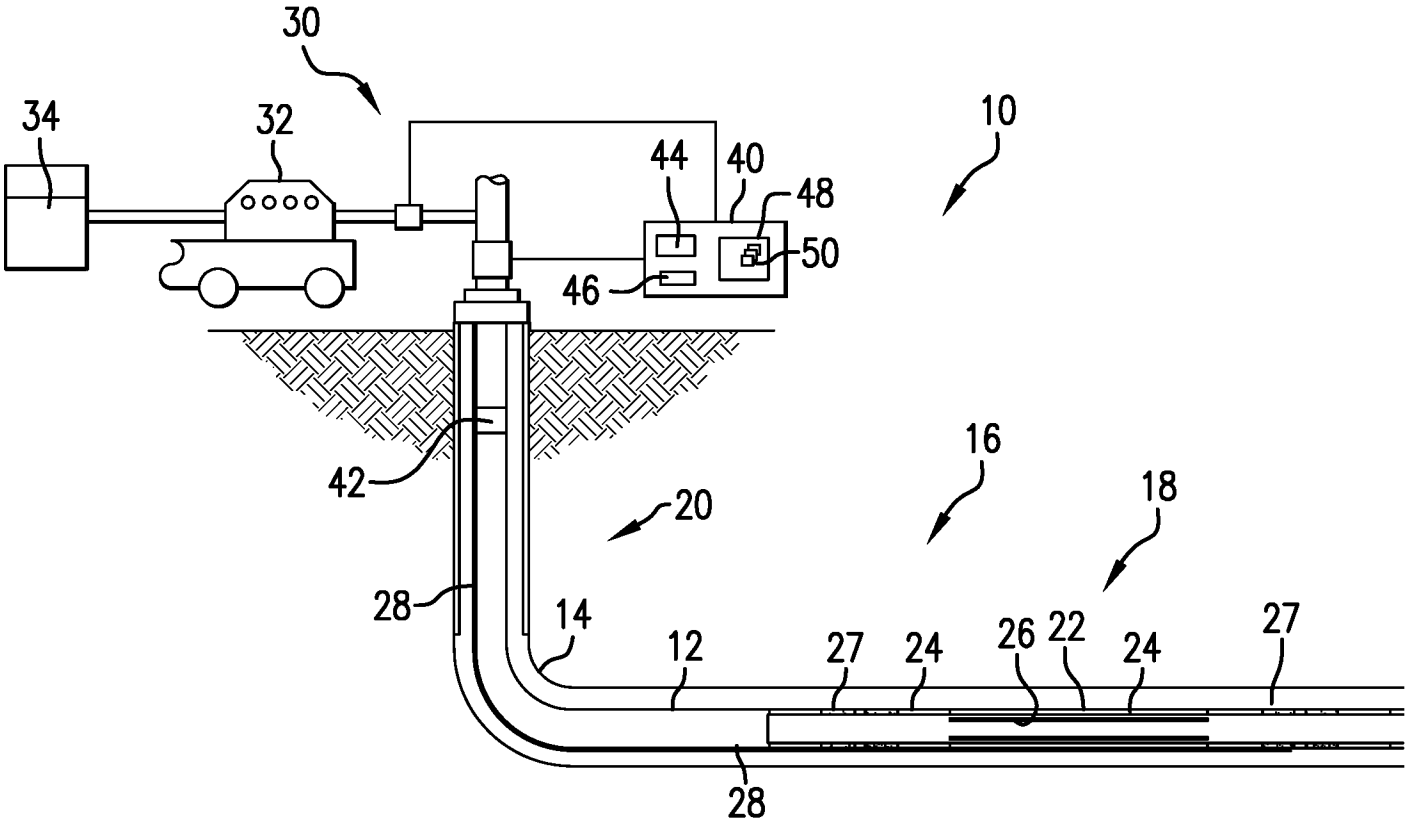
FIG. 1 illustrates an embodiment of a system for performing energy industry operations.

A detailed description of one or more embodiments of the disclosed apparatus and method presented herein by way of exemplification and not limitation with reference to the figures.

Systems, devices and methods are provided herein for monitoring a downhole component or components during deployment of the component in a downhole environment, and/or communicating component information during the deployment. An embodiment of a monitoring and/or communication system includes a downhole sensing device configured to acquire component information and/or information regarding a downhole environment (e.g., fluid properties, formation properties, borehole geometry, etc.). The component information, in one embodiment, is information related to the integrity of a downhole component being deployed, which can be transmitted to the surface in real time, for example, to determine whether the downhole component is operating properly or whether the component is damaged in some way. This allows any problems that may occur during deployment to be quickly identified before the downhole component has been fully run into the borehole and set at a target depth or location.

In one embodiment, the component information (and/or information related to the downhole environment) is transmitted wirelessly to the surface location during deployment. For example, the monitoring and/or communication system includes a wireless communication assembly having at least a wireless transmitter disposed at or in communication with a downhole component. The wireless communication assembly allows for communication with the surface during run-in without the need to run wires or conductors from the surface. Examples of wireless communication include acoustic and electromagnetic communications.

The monitoring and/or communication system utilizes a downhole sensing device. The sensing device may be connected to a downhole component (e.g., a sensing device in a running tool) and/or the sensing device may be part of the downhole component (e.g., a sensor disposed in a completion string). The system can be used to monitor component integrity and/or to perform downhole measurements during run-in.

The monitoring and/or communication system can monitor component integrity during deployment (run-in) by, in one embodiment, measuring a property of a signal conduit connected to a downhole component. Examples of signal conduits include electrical lines, optical fibers and hydraulic control lines. For example, a connection device connects one or more signal conduits (e.g., electrical, hydraulic and/or fiber optic lines) from components in a completion string to the running tool. During deployment or run-in, the system monitors the one or more signal conduits to detect damage, malfunction or other problems.

If a problem is detected, a communication signal is transmitted to a remote location (e.g., a drilling rig or other surface location) to inform a surface processor or human operator of the problem. In response, the completion string can be removed or other remediation can be performed long before it would have even been discovered in a prior art system.

The monitoring and/or communication system can utilize the downhole component to take measurements of a downhole environment. For example, the system can acquire measurement data from downhole sensors in a completion string being deployed, and the measurement data can be wirelessly transmitted to the surface. In another example, the completion string can itself include or be connected to a wireless transmitter. In the above examples, a power source such as a battery may be disposed downhole (e.g., in a running tool and/or the completion string) so that power can be provided thereto for monitoring and/or measurement purposes.

Embodiments described herein provide a number of advantages and technical effects. The running tool, monitoring assembly, and system and methods described herein provide for a cost-effective mechanism to monitor downhole components during deployment. For example, the connection device can be used to monitor line integrity while the blow-out preventer is closed, allowing components to be run with minimal losses. Line integrity can be monitored during deployment (e.g., run-in hole or RIH) to ensure that the components are set without damage to the components or associated control lines and/or other signal conduits.

Embodiments allow for monitoring some or all of the sensors, valves and/or other components as the components are run into a borehole. The monitoring is used to ensure that the components remain functioning during installation, and if a problem occurs, to promptly notify an operator so that appropriate mediation can be performed. For example, during two-trip lower completion, embedded sensors, tools, electrical conductors or hydraulic control lines can become compromised during the installation. The embodiments allow operators to detect component malfunction or damage (or control line damage) before the completions are advanced all the way to a desired depth. In this way, compromised components can be removed (tripped back out of the well) and substituted for a back-up instead of completing the installation, only to find out later that a critical system is not functional. Early indication as provided herein is important to success in delivering a working system.

In addition, embodiments described herein address challenges in so-called two-trip completions, which are deployed in two steps by installing a lower completion and subsequently installing an upper completion. An operator typically installs the lower completion "blind" when running with a typical running tool, since there is typically no means of generating power, providing communication to surface, or monitoring components while running. Options such as running fiber optic cable, electric conductors, or hydraulic lines from the surface to read the sensors can be time and cost prohibitive, be a health and safety logistics complication, and can be too mechanically complicated for an operator, as lines run from the surface are spooled into the well and serve as an opportunity to get hung up after setting the lower completion at depth. Embodiments described herein address such challenges by providing for monitoring and communication without the need to run lines from the surface.

FIG. 1 illustrates an embodiment of a system 10 for performing energy industry operations, such as a completion and hydrocarbon production system 10. The system 10 includes a borehole string 12, such as a production string, that is configured to be disposed in a borehole 14 that penetrates a resource bearing formation 16 or formation region. In one embodiment, the borehole string 12 includes a lower completion string 18 and an upper completion string 20 that connects the lower completion string 18 to the surface. The lower completion string 18 includes various components to facilitate stimulation and/or production, such as a production assembly 22 that includes a screen assembly 24 (e.g., a sand screen assembly or sub), a production fluid flow control apparatus such as an inflow control device (ICD) 26, and one or more packer assemblies 27. Various components may be configured to communicate with a surface location and/or a remote location, for example, via one or more conductors 28 (e.g., hydraulic lines, electrical conductors and/or optical fibers) and/or wireless telemetry (e.g., mud pulse, electromagnetic, etc.)

The system 10 also includes surface equipment 30 such as a drill rig, rotary table, top drive, blowout preventer and/or others to facilitate deploying the borehole string 12 and/or controlling downhole component. For example, the surface equipment 30 includes a fluid control system 32 including one or more pumps in fluid communication with a fluid tank 34 or other fluid source.

In one embodiment, the system 10 includes a processing device such as a surface processing unit 40, and/or a subsurface processing unit 42 disposed in the borehole 14 and connected to one or more downhole components. The surface processing unit 40, in one embodiment, includes a processor 44, an input/output device 46 and a data storage device (or a computer-readable medium) 48 for storing data, files, models, data analysis modules and/or computer programs. The processing device may be configured to perform functions such as controlling downhole components, controlling fluid circulation, monitoring components during deployment, transmitting and receiving data, processing measurement data and/or monitoring operations. For example, the storage device 48 stores processing modules 50 for performing one or more of the above functions.

FIGS. 2-5 depict aspects of the system 10 and also depict a component monitoring and/or communication system 80 configured to monitor the integrity of components and/or signal conduits (e.g., of the lower completion string 18) during deployment thereof. The component monitoring system includes a running tool 82, which is a tool or device used to facilitate deployment of downhole components into a borehole. The running tool 82 is configured to be removably attached or connected to a downhole component, so that once the downhole component is disposed at a desired depth or location, the running tool 82 can be released and retracted to the surface.

In the embodiments of FIGS. 2-5, the running tool 82 is used to deploy the lower completion string 18 as part of a two-trip completion. In a two-trip completion, a first downhole component such as the lower completion string 18 is deployed in the borehole 14 to a desired depth. Subsequently, a second downhole component is deployed and operably attached to the first downhole component. For example, after the lower completion string 18 has been deployed, the upper completion string 20 is deployed and operably connected to the lower completion string 18. Two-trip completions are useful, for example, in allowing an operator to workover the upper completion string 20 without having to retrieve the lower completion string 18.

It is noted that "upper" and "lower" are terms used to indicate a relative position in a borehole as measured from the surface. In vertical boreholes, a lower component has a vertical depth that is greater than an upper component. However, in deviated and horizontal boreholes, an upper and lower component can have the same vertical depth, or the upper component can have a greater vertical depth than the lower component.

Figure 2:
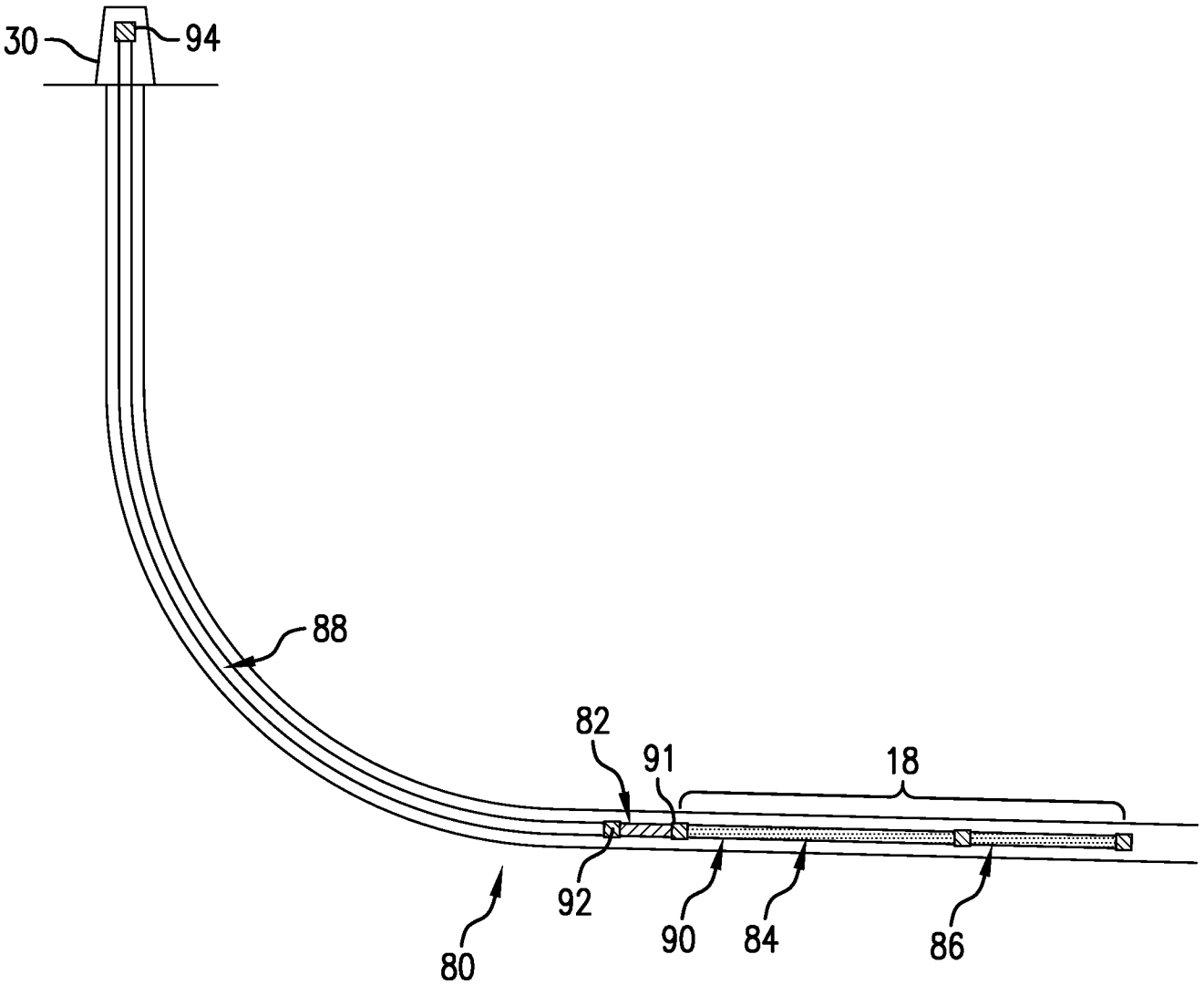
FIG. 2 depicts an embodiment of a monitoring system for monitoring a downhole component during deployment of the downhole component in a borehole, the monitoring system including a running tool, a connection device and a communication device.

Referring to FIG. 2, the lower completion string 18 includes a variety of tools or components. In this embodiment, the lower completion string 18 includes one or more sensors, such as a discrete sensor 84 and/or a distributed sensor such as a fiber optic sensor 86. It is noted that the lower completion string 18 may have components such as those shown in FIG. 1, or include any number of components and/or any type of downhole component.

To deploy the lower completion string 18, in one embodiment, a running string 88 is connected to the running tool 82, which is in turn connected to the lower completion string 18. The running string 88 may be a length of coiled tubing or other suitable elongated member.

The running tool 82 is connected to the lower completion string by a connection device 90, and is removably connectable to both the running string 88 and the lower completion string 18. The connection device 90 can be operably connected to one or more components of the lower completion string 18, i.e., so that the components can be monitored, powered and/or controlled. The running tool 82 and the connection device 90 may be modular devices for ease of connection, disconnection and replacement.

In one embodiment, the connection device 90 is a wet connection device connected to an upper end of the lower completion string 18. The wet connection device (or other connection device 90) allows for the communication of components of the lower completion string 18 to the upper completion string 20. This beneficial capability allows an operator to run sensors, flow control equipment and even chemical injection all the way to a payzone. During deployment, the wet connection device includes suitable connectors to operably connect power and/or control lines from the lower completion string 18 to the running tool 82. For example, the wet connection device connects fiber optic, electric and/or hydraulic lines to the running tool 82, allowing the running tool 82 to monitor, provide power to, and/or control various downhole components.

The running tool 82 may include a processing device 91 or unit that acquires information related to the downhole components of the lower completion string 18, which can be used to monitor properties of the components as the lower completion string 18 is deployed through the borehole 14. The processing device 91, in conjunction with suitable sensors, acquires data relating to the downhole components in order to monitor the integrity of the downhole components. The monitoring identifies any problems, malfunctions, damage or other conditions that result in sub-optimal performance or failure of the components.

In addition to (or in place of) monitoring component integrity, the system 80 may be configured to acquire measurement data from a downhole component (e.g., the discrete sensor 84) related to the downhole environment. Examples of measurement data include formation properties (e.g., porosity, permeability, fracture properties, lithology), fluid properties (e.g., fluid composition, pressure, flow rate, etc.), and borehole properties such as borehole geometry and/or trajectory. Such measurement data can be used to generate a well log that can be used for subsequent runs. For example, measuring borehole geometry can be used to estimate borehole properties and identify obstructive geometries that can be accounted for when mating the wet connection device to the upper completion string 20. This allows calculation of the forces that will be reacted out such that the weight applied at surface is substantially reduced at the wet connect to avoid damage to the wet connect and ensure a proper connection.

The running tool 82, the processing device 91 and/or sensors therein, in one embodiment, are connected to a downhole power source, such as a battery or turbine generator. The downhole power source may be used to provide power to the processing device 91 and/or sensors, without the need for a connection to the surface. The downhole power source may be used to provide power to electrically operate sensors or tools in the lower completion string 18.

In the embodiment of FIG. 2, the processing device 91 is connected to power and/or signal conduits of the downhole components. For example, the optical fiber sensor 86 is connected to the connection device 90. An electrical line (for power and/or communication) attached to the sensor 84 can be monitored via the connection device 90, for example, by measuring resistance of the electrical line and determining based on the resistance whether the electrical line is compromised.

The connection device 90 includes or is connected to a downhole communication device 92 configured to transmit a signal to a receiver at a surface location, such as a receiver connected to a surface acquisition unit 94. The communication device 92 may communicate with the surface acquisition unit 94 via wired communication (e.g., fiber optic and/or electrical), or wirelessly as discussed below.

It is noted that the embodiments described herein may exclude the communication 92, or methods utilizing the monitoring and/or communication system 80 may omit use of the communication device. For example, if desired, the running tool 82 or other downhole component includes memory for storing data acquired when monitoring the lower completion string 18. The acquired data may be collected at the surface after retrieval of the running tool 82 for later evaluation.

In one embodiment, the monitoring and/or communication system 80 is configured to wirelessly communicate between the running tool 82 and the surface acquisition unit 94 or other remote location. The remote location may be a surface location (e.g., at the surface equipment 30) or another location away from the surface equipment. For example, the communication device 92 is a downhole wireless communication device 92 configured to transmit a signal to the acquisition unit 94. The acquisition unit 94 may include a receiver and suitable processing device to detect and analyze wireless signals transmitted from the wireless. The surface acquisition unit 94 may also include or be connected to a wireless transmitter to allow communication from the surface. Likewise, the downhole communication device 92 may include a receiver. It is noted that the running tool 82, the connection device 90 and/or the transmitter may be modular, allowing various components to be readily assembled without requiring any substantial redesign or modification. Wireless communication allows the lower completion string 18 to be deployed via the running string 88 and monitored during deployment without requiring the use of wires, cables or other physical communication mechanisms.

The wireless communication device 92 may utilize any form of wireless communication. In the following embodiments, the wireless communication device 92 employs acoustic or electromagnetic signals. Other forms of communication include, for example, mud pulse or fluid telemetry.

Figure 3:
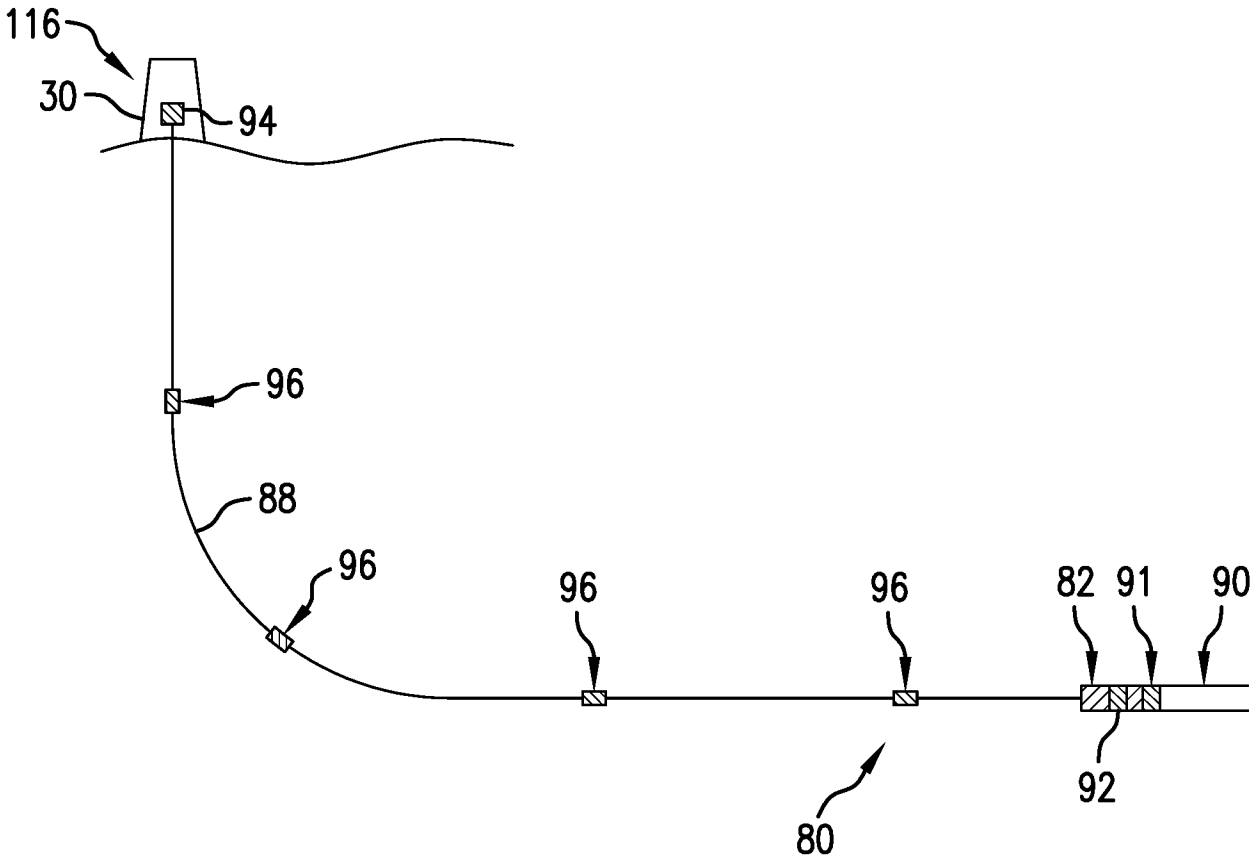
FIG. 3 depicts an embodiment of the monitoring system of FIG. 1, including a downhole wireless communication device configured to acoustically communicate with a remote location.

Referring to FIG. 3, in one embodiment, the wireless communication device 92 includes an acoustic transmitter that emits encoded acoustic signals. Optionally, the running string 88 includes an array of acoustic relays or transceivers 96 that operate to detect acoustic signals from the downhole communication device 92 and successively relay acoustic signals that are eventually detected by the surface acquisition device 94. The array may also relay acoustic signals from the surface acquisition device 94 to the downhole communication device 92.

Figure 4:
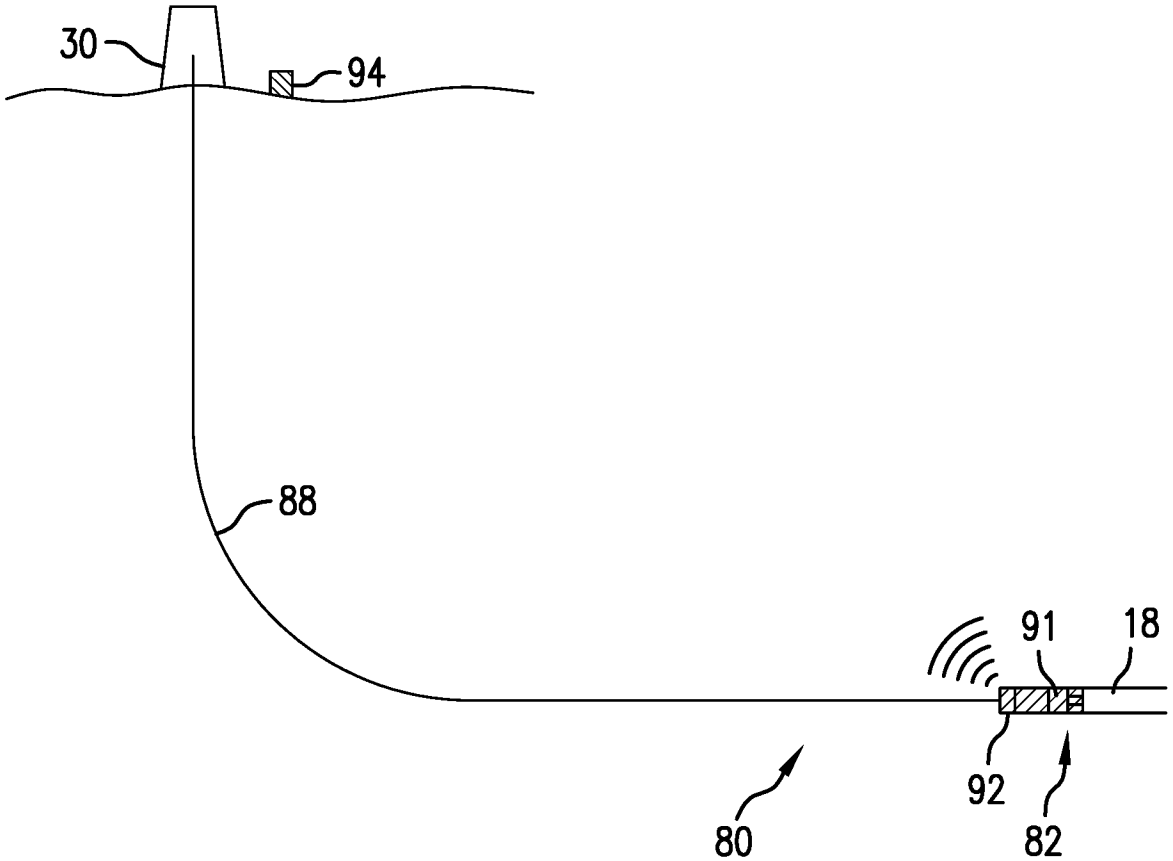
FIG. 4 depicts an embodiment of the monitoring system of FIG. 1, including a downhole wireless communication device configured to communicate with a remote location via electromagnetic signals.

In one embodiment, referring to FIG. 4, the downhole communication device 92 is configured to transmit electromagnetic signals as part of an electromagnetic telemetry system.

It is noted that the downhole communication device 92 can be disposed at any suitable downhole location. For example the downhole communication device 92 can be disposed in the running tool 82 or in the lower completion string 18.

Figure 5:
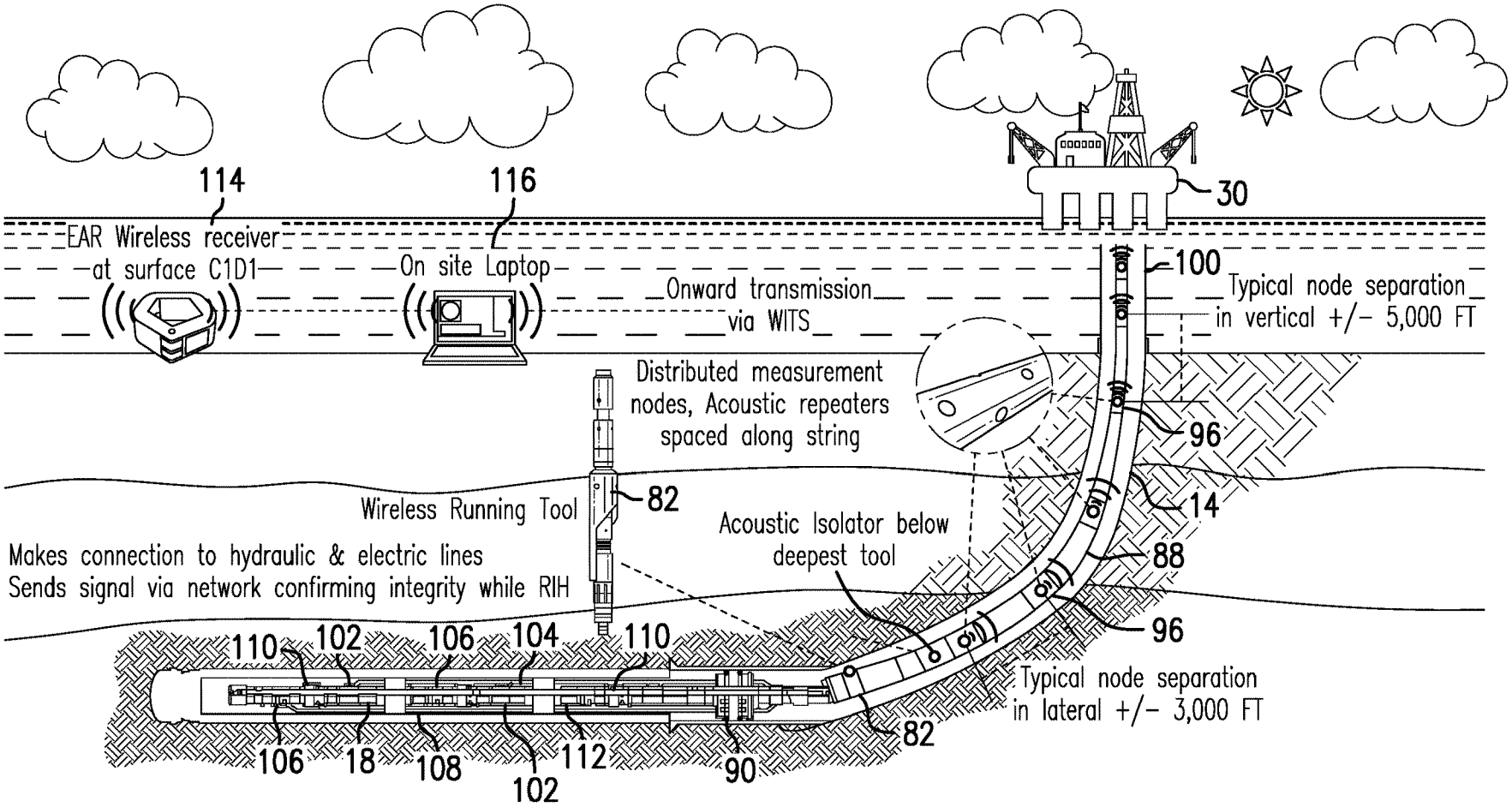
FIG. 5 depicts an embodiment of a monitoring system for monitoring a downhole component during deployment of the downhole component from an offshore rig into a borehole, the monitoring system including a running tool, a connection device and a wireless communication device.

FIG. 5 depicts another example of the monitoring and/or communication system 80. In this example, the borehole 14 is in a subsea region and is connected to the surface equipment 30 (in this example an offshore rig) via a riser 100. The running string 88 is a coiled tubing string having an array of acoustic relays 96 separated by selected distances. Examples of distances between relays 96 include about 3,000 to 5,000 feet. The running tool 82, as discussed above, includes at least a transmitter and may also include a receiver.

The lower completion string 18 in this example is a smart or intelligent completion that includes electrically powered sensors 102 connected to an electric conductor 104, optical fiber sensors 106 connected to an optical fiber 108, and hydraulic control valves 110 connected to a hydraulic control line 112.

In this example, the lower completion string is configured as a "smart" or "intelligent" completion. Smart or intelligent well technology involves measurement and reservoir flow control features that are disposed downhole. Installation of downhole active flow control devices (multi-node), inflow control valves, measurement devices (e.g., for pressure, temperature and flow rate), and/or downhole processing facilities such as hydro-cyclones in the borehole allows for active production monitoring and control. Intelligent wells facilitate control of parameters such as fluid flow and pressure, and facilitate periodically or continuously updating reservoir models during production.

The connection device 90 is a wet connector that connects the electric lines 104, the optical fiber 108 and the hydraulic control lines 112 to the running tool 82. The running tool 82 includes at least an acoustic transmitter used to transmit acoustic signals that are relayed to the surface. In this example, acoustic signals transmitted from the running tool 82 are relayed to a wireless receiver 114 in communication with a surface processing device 116.

Figure 6:
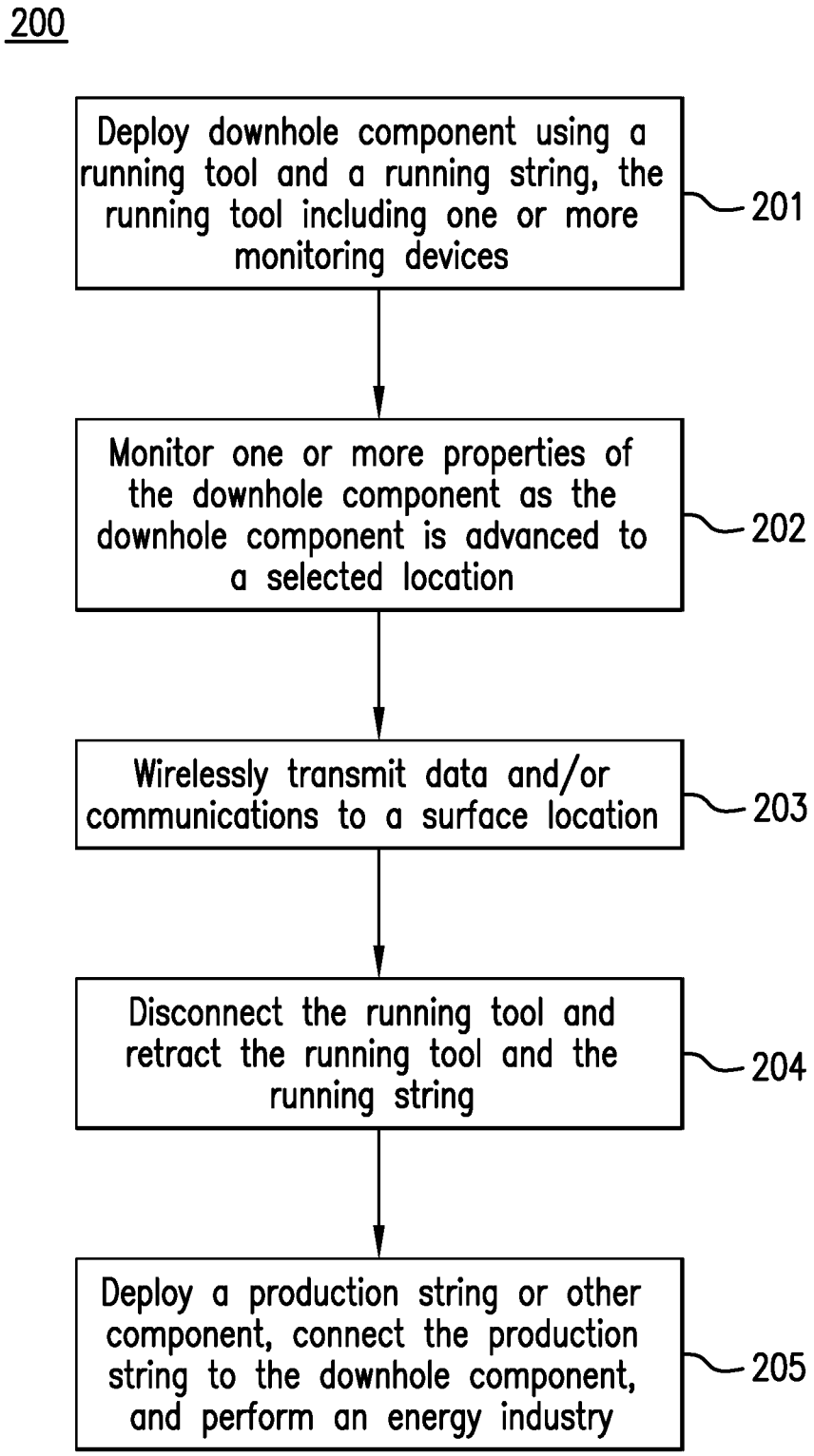
FIG. 6 is a flow chart depicting an embodiment of a method of monitoring a downhole component during deployment of the downhole component in a borehole.

FIG. 6 is a flow chart that illustrates an embodiment of a method 200 of monitoring downhole components during deployment, and/or controlling aspects of an energy industry operation. Aspects of the method 200, or functions or operations performed in conjunction with the method, may be performed by one or more processing devices, such as the surface processing unit 40, the surface acquisition unit 94 and/or the surface processing unit 116, either alone or in conjunction with a human operator.

The method 200 includes one or more stages 201-205. In one embodiment, the method 200 includes the execution of all of the stages 201-205 in the order described. However, certain stages may be omitted, stages may be added, or the order of the stages changed.

The method 200 is discussed in conjunction with the system of FIG. 5 for illustrative purposes. It is noted that the method is not limited to the specific embodiment discussed below.

In the first stage 201, one or downhole components, such as the lower completion string 18, are prepared to be deployed into a borehole by connecting an upper end of the lower completion string 18 to a connection device such as the wet connection device 90. The various control lines connected to components of the lower completion string 18 are connected to the wet connection device 90, which is in turn connected to the running tool 82.

In the second stage 202, the lower completion string 18 is deployed into the borehole and advanced downhole to a desired location using the running string 88. During the advancement, downhole components in the lower completion string 18 are monitored via the running tool 82. In one embodiment, sensors and/or a processing device in the running tool 82, or connected to the running tool 82, monitor the components by, for example monitoring the control lines to determine whether component integrity is maintained. The running tool 82, in one embodiment, is powered by a battery or other downhole power source.

For example, the running tool 82 provides power to the electrical sensors 102 and can periodically or continuously monitor the sensors 102 by communicating with the sensors 102 to ensure that they are working properly. In addition, or alternatively, a sensor such as a megohmmeter in the running tool 82 is used to monitor the integrity of the conductors 104. In another example, hydraulic pressure sensors in the running tool 82 may monitor the hydraulic control line 112 to ensure that the hydraulic control line 112 is not damaged or compromised.

In the third stage 203, data and/or communications are transmitted to the surface via a downhole wireless communication device. The data and/or communications may be sensor readings, alerts and any other information indicative of the integrity and health of the lower completion string 18 and components thereof. The communications may be transmitted and detected at the surface in real time.

For example, if the processing device in the running tool 82 determines (e.g., based on resistance measurements) that the electrical conductor 104 is damaged disconnected, an encoded acoustic signal is emitted and relayed via the relays 96 at the running string 88. A surface processor or human operator can receive the signal and perform appropriate remediation measures, such as retrieving the lower completion string 18 from the borehole for repair or replacement of components.

In the fourth stage 204, when the lower completion string 18 reaches the desired location, and no damage or other problem has been detected, the running tool 82 is released and the running tool, the connection device and the running string are retrieved. In the fifth stage 205, an upper completion string 20 is deployed and connected to the lower completion string 18. An energy industry operation, such as a production and/or stimulation operation, can then be performed.

Set forth below are some embodiments of the foregoing disclosure:

Embodiment 1: A system for monitoring a downhole component, comprising: a downhole sensing device configured to monitor a downhole component and generate component information during deployment of the of the downhole component to a selected location in a borehole in a resource bearing formation; and a downhole communication device connected to the downhole sensing device, the downhole communication device configured to wirelessly transmit a signal indicative of the component information to a surface location during the deployment.

Embodiment 2: The system of any prior embodiment, wherein the downhole sensing device is configured to measure a property of a signal conduit of the downhole component.

Embodiment 3: The system of any prior embodiment, wherein the signal conduit is selected from at least one of an electrical conductor, a hydraulic control line and an optical fiber.

Embodiment 4: The system of any prior embodiment, wherein the measured property is indicative of component integrity.

Embodiment 5: The system of any prior embodiment, wherein the downhole communication device is configured to transmit a communication to the surface location based on a detecting malfunction of the signal conduit or damage to the signal conduit.

Embodiment 6: The system of any prior embodiment, wherein the wirelessly transmitted signal is selected from at least one of an acoustic signal and an electromagnetic signal.

Embodiment 7: The system of any prior embodiment, further comprising a running tool removably connected to the downhole component, the running tool configured to be used to advance the downhole component to a selected location.

Embodiment 8: The system of any prior embodiment, wherein the running tool is configured to be removably connected to a running string, the wireless communication device includes an acoustic transmitter, and the running string includes at least one acoustic relay device configured to relay an acoustic signal from the acoustic transmitter to an acoustic receiver at a surface location.

Embodiment 9: The system of any prior embodiment, further comprising a connection device removably connected to the running tool and the downhole component, the connection device configured to operably connect at least one signal conduit from the downhole component to the running tool.

Embodiment 10: The system of any prior embodiment, wherein the downhole component is an intelligent lower completion string.

Embodiment 11: A method of monitoring a downhole component, comprising: deploying a downhole component in a borehole in a resource bearing formation and advancing the downhole component to a selected location in the borehole; monitoring the downhole component during deployment by a downhole sensing device and generating component information; and wirelessly transmitting a signal during the deployment to a surface location by a downhole communication device connected to the downhole sensing device, the signal indicative of the component information.

Embodiment 12: The method of any prior embodiment, wherein the monitoring includes measuring a property of a signal conduit of the downhole component.

Embodiment 13: The method of any prior embodiment, wherein the signal conduit is selected from at least one of an electrical conductor, a hydraulic control line and an optical fiber.

Embodiment 14: The method of any prior embodiment, wherein the measured property is indicative of component integrity.

Embodiment 15: The method of any prior embodiment, wherein the downhole communication device is configured to transmit a communication to the surface location based on a detecting malfunction of the signal conduit or damage to the signal conduit.

Embodiment 16: The method of any prior embodiment, wherein the wirelessly transmitted signal is selected from at least one of an acoustic signal and an electromagnetic signal.

Embodiment 17: The method of any prior embodiment, wherein the downhole component is connected to a running tool during the deployment, the running tool configured to be used to advance the downhole component to a selected location.

Embodiment 18: The method of any prior embodiment, wherein the running tool is configured to be removably connected to a running string, the wireless communication device includes an acoustic transmitter, and the running string includes at least one acoustic relay device configured to relay an acoustic signal from the acoustic transmitter to an acoustic receiver at a surface location.

Embodiment 19: The method of any prior embodiment, wherein the running tool is connected to the downhole component by a connection device removably connected to the running tool and the downhole component, the connection device configured to operably connect at least one signal conduit from the downhole component to the running tool.

Embodiment 20: The method of any prior embodiment, wherein the downhole component is an intelligent lower completion string.

In support of the teachings herein, various analysis components may be used, including a digital and/or an analog system. For example, embodiments such as the system 10, downhole tools, hosts and network devices described herein may include digital and/or analog systems. Embodiments may have components such as a processor, storage media, memory, input, output, wired communications link, user interfaces, software programs, signal processors (digital or analog), signal amplifiers, signal attenuators, signal converters and other such components (such as resistors, capacitors, inductors and others) to provide for operation and analyses of the apparatus and methods disclosed herein in any of several manners well-appreciated in the art. It is considered that these teachings may be implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for monitoring a downhole component, comprising:

a downhole sensing device configured to monitor a downhole component and generate component information during deployment of the of the downhole component to a selected location in a borehole in a resource bearing formation, the component information including a measured property of a signal conduit connected to the downhole component, the measured property acquired by the downhole sensing device during the deployment, the measured property indicative of integrity of the downhole component; and a downhole communication device connected to the downhole sensing device, the downhole communication device configured to wirelessly transmit a signal indicative of the component information to a surface location during the deployment.

2. The system of claim 1, wherein the signal conduit is selected from at least one of an electrical conductor, a hydraulic control line and an optical fiber.

3. The system of claim 1, wherein the downhole communication device is configured to transmit a communication to the surface location based on a detecting malfunction of the signal conduit or damage to the signal conduit.

4. The system of claim 1, wherein the wirelessly transmitted signal is selected from at least one of an acoustic signal and an electromagnetic signal.

5. The system of claim 1, further comprising a running tool removably connected to the downhole component, the running tool configured to be used to advance the downhole component to a selected location.

6. The system of claim 5, wherein the running tool is configured to be removably connected to a running string, the wireless communication device includes an acoustic transmitter, and the running string includes at least one acoustic relay device configured to relay an acoustic signal from the acoustic transmitter to an acoustic receiver at a surface location.

7. The system of claim 5, further comprising a connection device removably connected to the running tool and the downhole component, the connection device configured to operably connect at least one signal conduit from the downhole component to the running tool.

8. The system of claim 1, wherein the downhole component is an intelligent lower completion string.

9. A method of monitoring a downhole component, comprising:

deploying a downhole component in a borehole in a resource bearing formation and advancing the downhole component to a selected location in the borehole;

monitoring the downhole component during deployment by a downhole sensing device and generating component information, wherein the component information includes a measured property of a signal conduit connected to the downhole component, and the monitoring includes acquiring the measured property by the downhole sensing device during the deployment, the measured property indicative of integrity of the downhole component; and wirelessly transmitting a signal during the deployment to a surface location by a downhole communication device connected to the downhole sensing device, the signal indicative of the component information.

10. The method of claim 9, wherein the signal conduit is selected from at least one of an electrical conductor, a hydraulic control line and an optical fiber.

11. The method of claim 9, wherein the downhole communication device is configured to transmit a communication to the surface location based on a detecting malfunction of the signal conduit or damage to the signal conduit.

12. The method of claim 9, wherein the wirelessly transmitted signal is selected from at least one of an acoustic signal and an electromagnetic signal.

13. The method of claim 9, wherein the downhole component is connected to a running tool during the deployment, the running tool configured to be used to advance the downhole component to a selected location.

14. The method of claim 13, wherein the running tool is configured to be removably connected to a running string, the wireless communication device includes an acoustic transmitter, and the running string includes at least one acoustic relay device configured to relay an acoustic signal from the acoustic transmitter to an acoustic receiver at a surface location.

15. The method of claim 13, wherein the running tool is connected to the downhole component by a connection device removably connected to the running tool and the downhole component, the connection device configured to operably connect at least one signal conduit from the downhole component to the running tool.

16. The method of claim 9, wherein the downhole component is an intelligent lower completion string.

* * * * *